US006874906B1

(12) United States Patent
Dorney

(10) Patent No.: US 6,874,906 B1
(45) Date of Patent: Apr. 5, 2005

(54) CHEMILUMINESCENT LID FOR CUP

(76) Inventor: Peter Dorney, 950 S. Winter Park Dr., Suite 101, Casselberry, FL (US) 32707

( * ) Notice: Subject to any disclaimer, the term of this patent is extended or adjusted under 35 U.S.C. 154(b) by 0 days.

(21) Appl. No.: 10/261,703

(22) Filed: Oct. 1, 2002

(51) Int. Cl.[7] ..... F21V 33/00
(52) U.S. Cl. ..... 362/154; 362/101; 362/104
(58) Field of Search ..... 362/34, 84, 101, 362/103, 104, 105, 107, 154, 362, 363, 367, 362/800, 375, 368

(56) References Cited

U.S. PATENT DOCUMENTS 3,017,051 A * 1/1962 Rosenfeld ..... 362/34
4,261,026 A * 4/1981 Bolha ..... 362/101
4,336,574 A * 6/1982 Goodman ..... 362/101
4,405,973 A * 9/1983 Moscarillo ..... 362/34
4,814,949 A * 3/1989 Elliott ..... 362/34
5,044,509 A * 9/1991 Petrosky et al. ..... 362/101
5,695,270 A * 12/1997 Collet ..... 362/34
6,082,866 A * 7/2000 Amedee ..... 362/34
6,371,624 B1 * 4/2002 Dorney ..... 362/34
6,520,657 B1 * 2/2003 DeNicola ..... 362/34

* cited by examiner

*Primary Examiner*—John Anthony Ward
*Assistant Examiner*—Isamel Negron
(74) *Attorney, Agent, or Firm*—Edward P. Dutkiewicz

(57) ABSTRACT

A generally cylindrical lid fabricated of a translucent material has a top portion having a hollow chamber with a rigid lower wall and an upper wall being formed of a relatively flexible material and a peripheral lower lip portion having a curved central recess. A first chemiluminescent liquid is located in the hollow chamber. An ampule, located within the curved recess of the lower wall of the hollow chamber, is adapted to be broken by a user upon compression of the flexible material. A second chemical luminescent liquid, located within the ampule, is adapted to intermix with the first liquid and fill the hollow chamber.

2 Claims, 9 Drawing Sheets

FIG 3
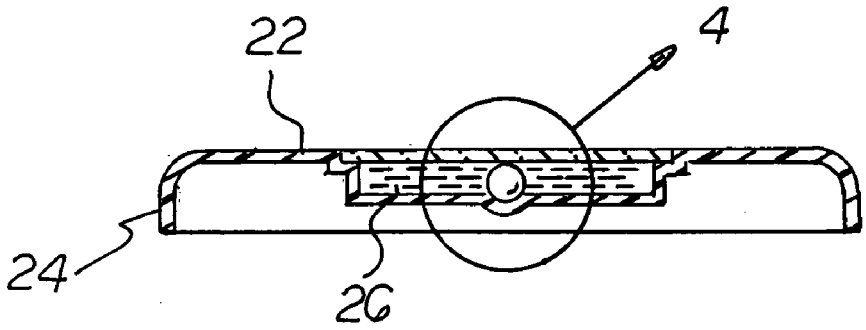
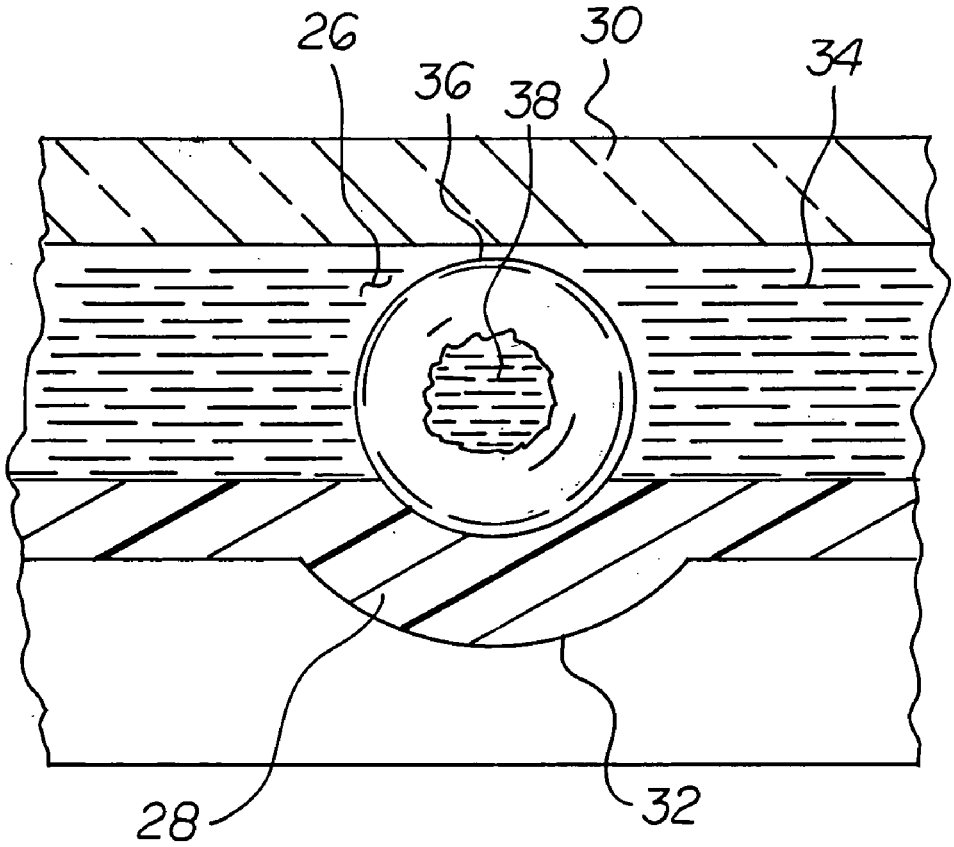
FIG 4

FIG 5
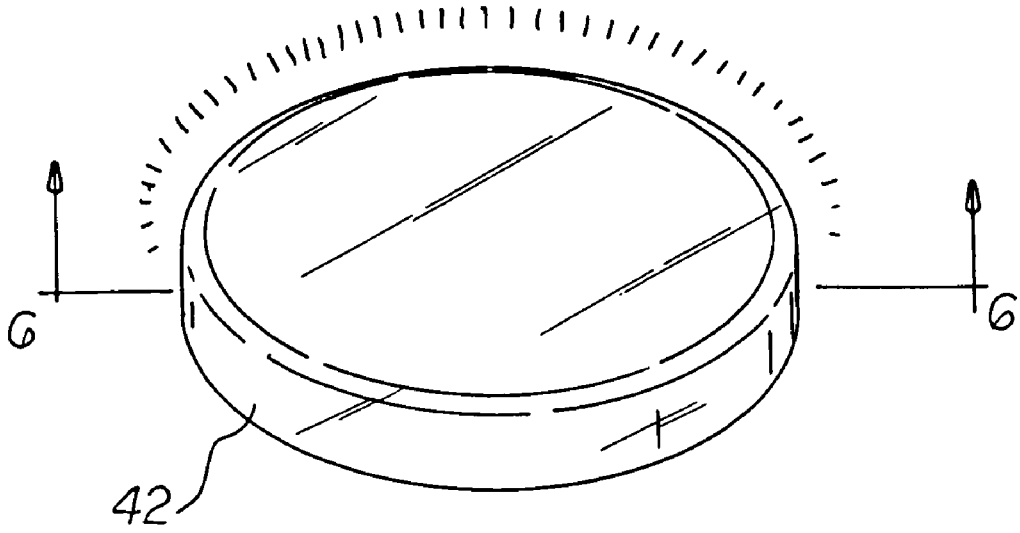
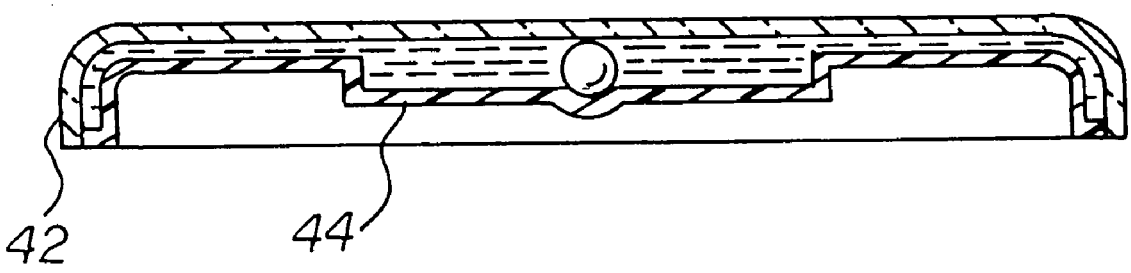
FIG 6

FIG 7
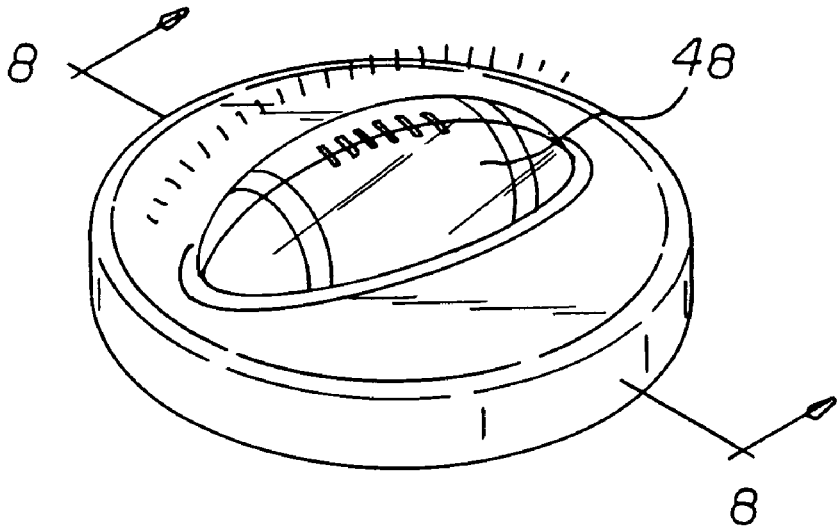
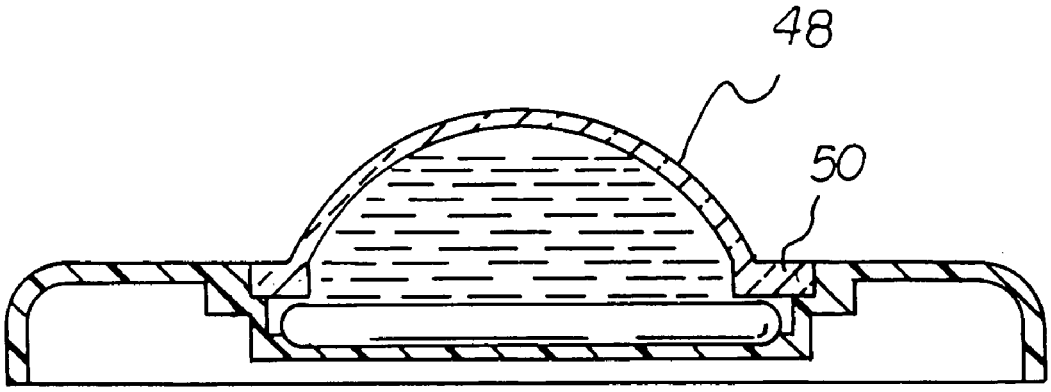
FIG 8

FIG 9
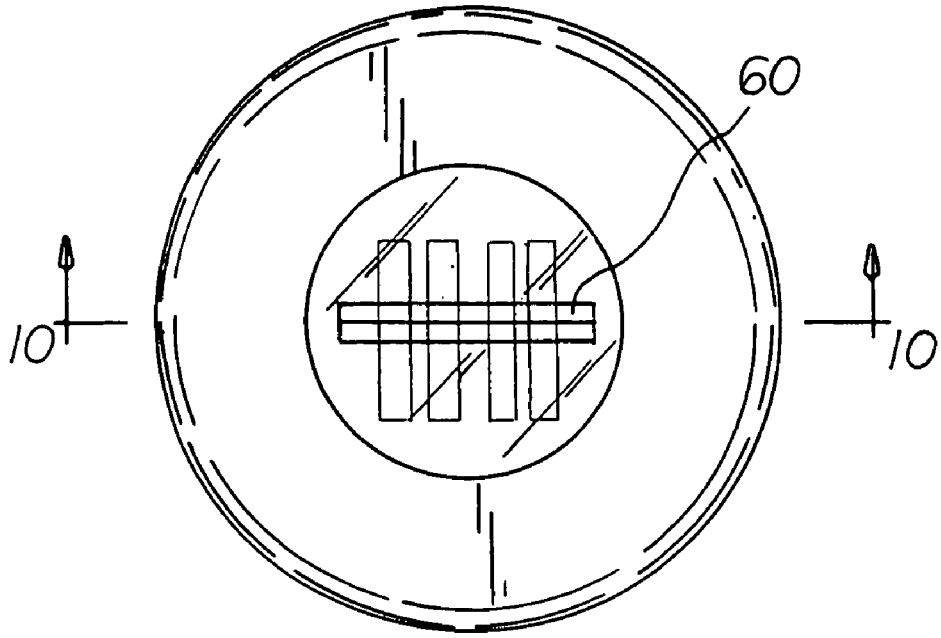
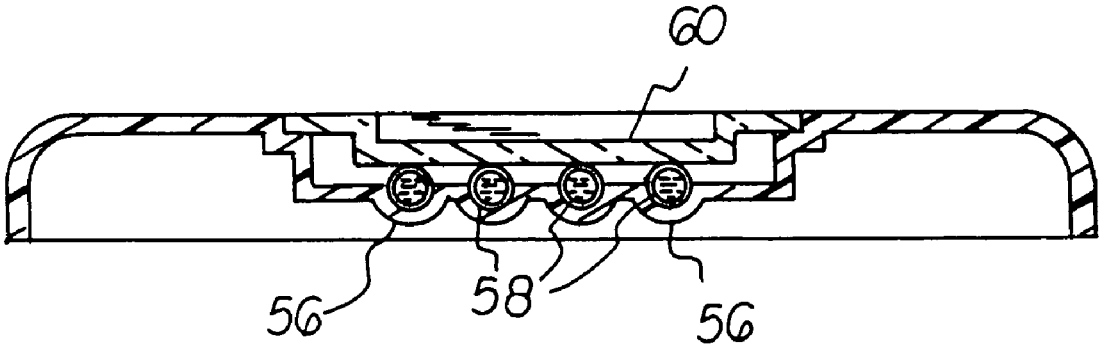
FIG 10

FIG. 11
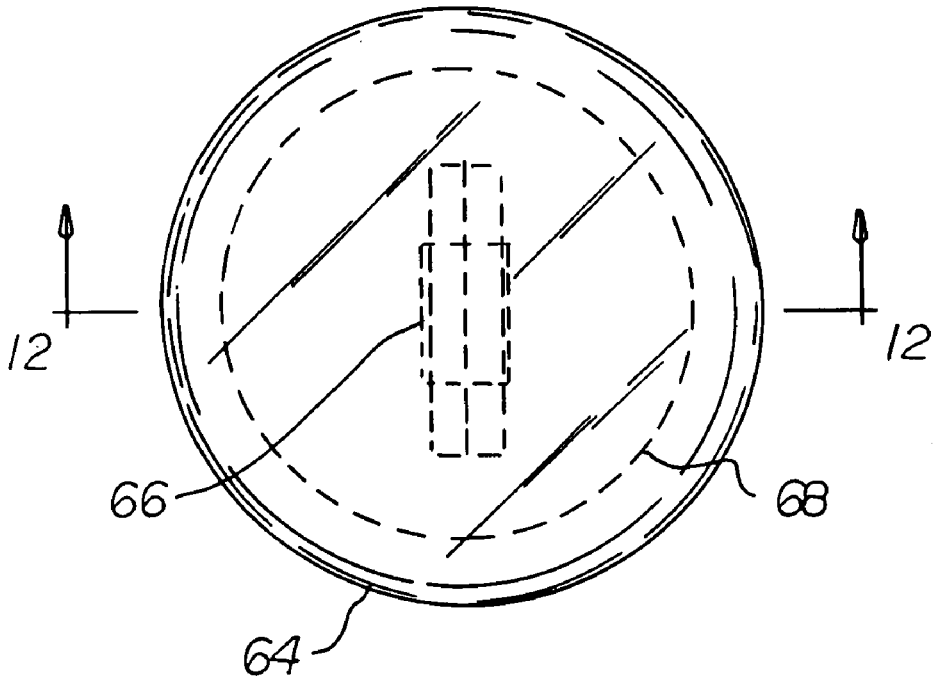
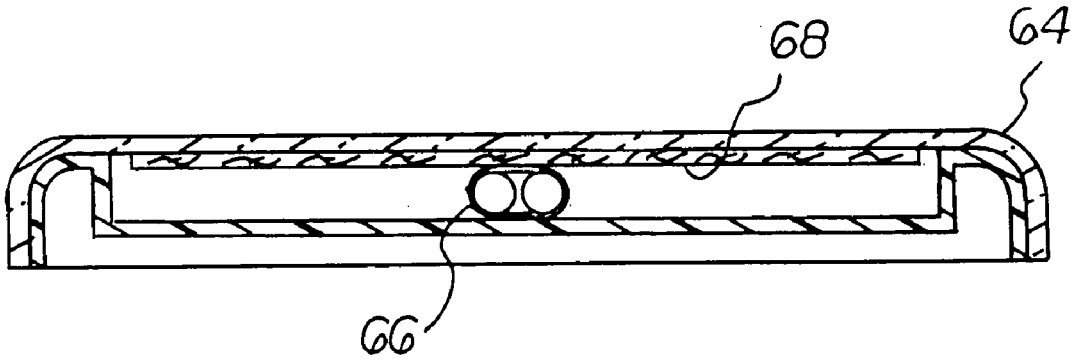
FIG 12

FIG 13
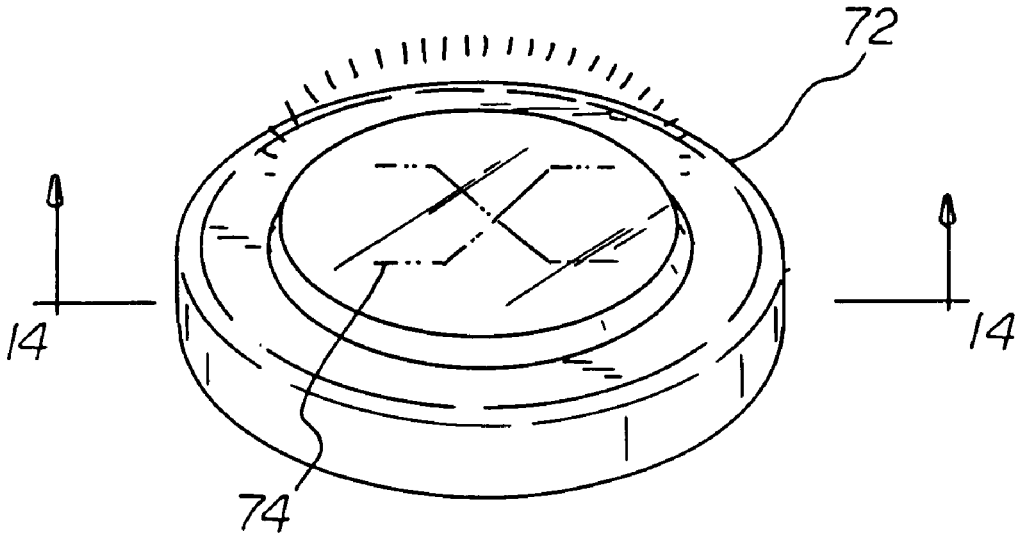
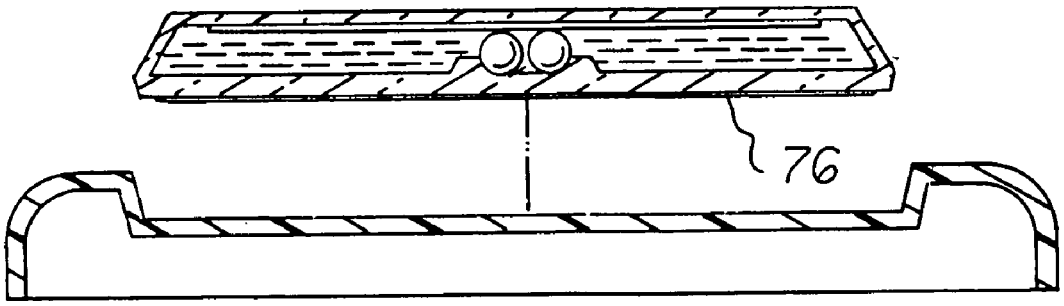
FIG 14

FIG 15
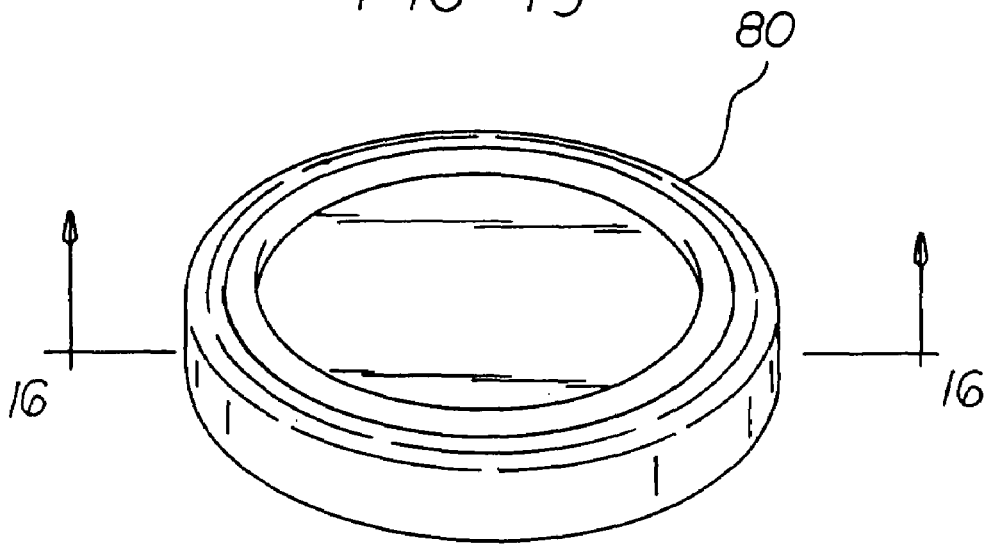
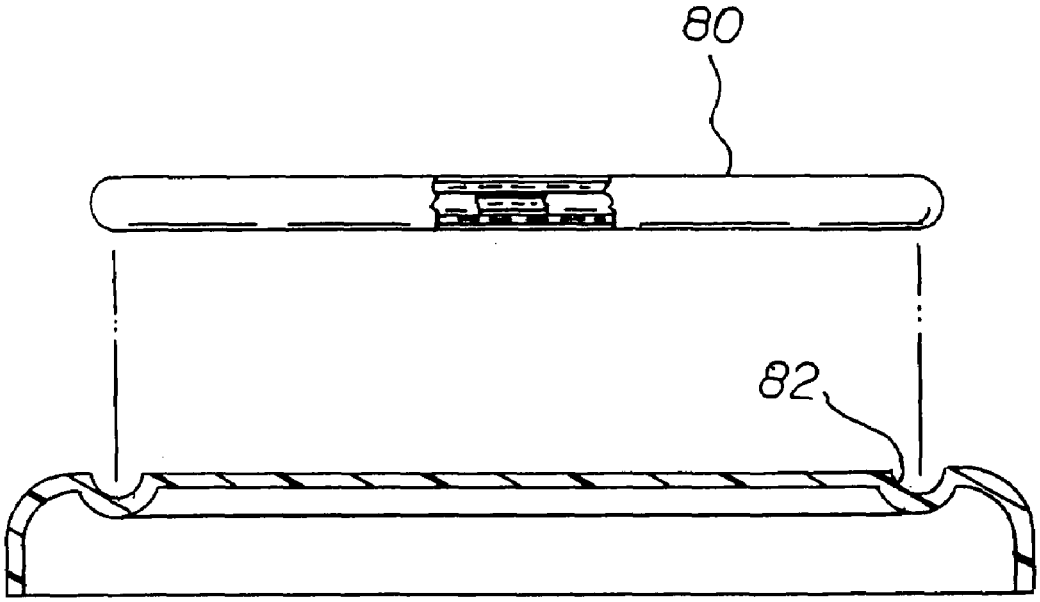
FIG 16

FIG 17
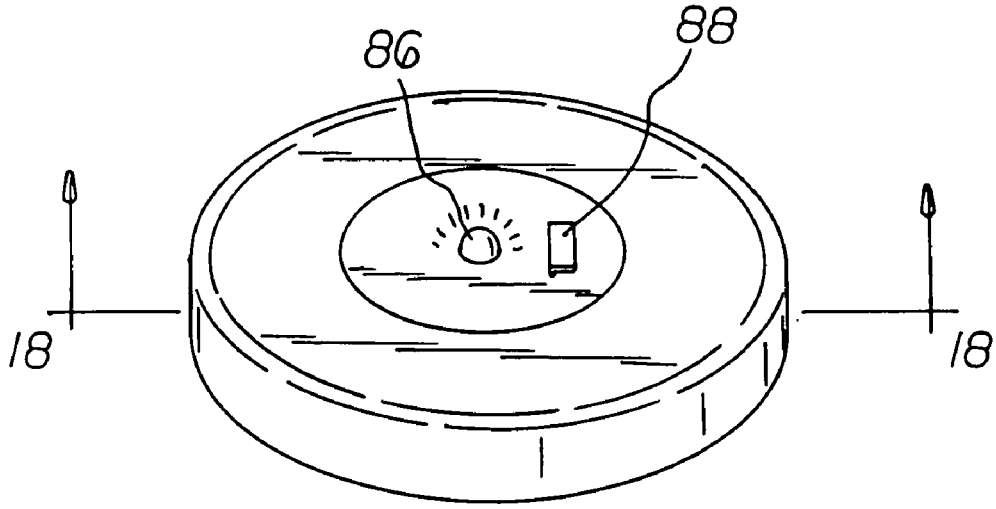
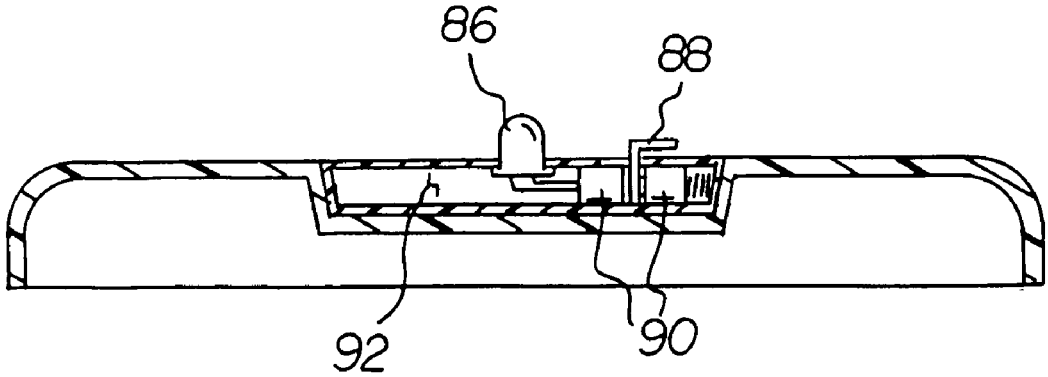
FIG 18

CHEMILUMINESCENT LID FOR CUP

BACKGROUND OF THE INVENTION

1. Field of the Invention

The present invention relates to a cup and lid system and more particularly pertains to illuminating the lid of a cup for an attractive combination.

2. Description of the Prior Art

The use of cups and lids of known designs and configurations is known in the prior art. More specifically, cups and lids of known designs and configurations previously devised and utilized for the purpose of illuminating objects through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,171,081 to Pita et al. discloses a chemiluminescent reactive vessel. Further, U.S. Pat. No. 6,062,380 to Dorney discloses a glow system.

While these devices fulfill their respective, particular objectives and requirements, the aforementioned patents do not describe a cup and lid system that allows illuminating the lid of a cup for an attractive combination.

In this respect, the cup and lid system according to the present invention substantially departs from the conventional concepts and designs of the prior art, and in doing so provides an apparatus primarily developed for the purpose of illuminating the lid of a cup for an attractive combination.

Therefore, it can be appreciated that there exists a continuing need for a new and improved cup and lid system which can be used for illuminating the lid of a cup for an attractive combination. In this regard, the present invention substantially fulfills this need.

SUMMARY OF THE INVENTION

In view of the foregoing disadvantages inherent in the known types of cups and lids of known designs and configurations now present in the prior art, the present invention provides an improved cup and lid system. As such, the general purpose of the present invention, which will be described subsequently in greater detail, is to provide a new and improved cup and lid system and method which has all the advantages of the prior art and none of the disadvantages.

To attain this, the present invention essentially comprises a cup of a generally cylindrical configuration with a first diameter and a first height. The cup is fabricated of a translucent material. The cup has a top lip and a bottom and a cylindrical side edge. Next provided is a lid. The lid is of a generally cylindrical configuration of a second diameter and a second height. The second diameter is slightly larger than the first diameter. The second height is considerably less than the first height. The lid is fabricated of a translucent material. The lid has a circular top portion and a cylindrical peripheral lower lip portion. The top portion has a hollow chamber. The hollow chamber has a rigid lower wall and an upper wall formed of a relatively flexible material. The rigid lower wall has a curved recess. The lid is adapted to be removably coupled to the top lip of the cup.

A first chemiluminescent liquid is next provided. The first chemiluminescent liquid is located throughout the hollow chamber. Next provided is a glass ampule. The glass ampule is located within the hollow chamber. The glass ampule is restrained from movement by the curved recess of the lower wall of the hollow chamber. The glass ampule is adapted to be broken by a user upon deformation of the flexible material. Finally, a second chemiluminescent liquid is provided. The second chemiluminescent liquid is located within the ampule. The second chemiluminescent liquid is adapted to intermix with the first liquid and fill the hollow chamber upon breaking of the ampule. When the first and second chemiluminescent liquids intermix, illumination is produced within the lid.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cup and lid system which has all of the advantages of the prior art cups and lids of known designs and configurations and none of the disadvantages.

It is another object of the present invention to provide a new and improved cup and lid system which may be easily and efficiently manufactured and marketed.

It is further an object of the present invention to provide a new and improved cup and lid system which is of durable and reliable constructions.

An even further object of the present invention is to provide a new and improved cup and lid system which is susceptible of a low cost of manufacture with regard to both materials and labor, and which accordingly is then susceptible of low prices of sale to the consuming public, thereby making such cup and lid system economically available to the buying public.

Even still another object of the present invention is to provide a cup and lid system for illuminating the lid of a cup for an attractive combination.

Lastly, it is an object of the present invention to provide a new and improved generally cylindrical lid fabricated of a translucent material. The lid has a top portion having a hollow chamber with a rigid lower wall and an upper wall being formed of a relatively flexible material and a peripheral lower lip portion having a curved central recess. A first chemiluminescent liquid is located in the hollow chamber. An ampule, located within the curved recess of the lower wall of the hollow chamber, is adapted to be broken by a user upon compression of the flexible material. A second chemical luminescent liquid, located within the ampule, is adapted to intermix with the first liquid and fill the hollow chamber.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2.

FIG. 4 is an enlarged illustration taken at circle 4 of FIG. 3.

FIG. 5 is a plan view similar to FIG. 2 but illustrating an alternate embodiment of the invention with the illumination extending over the edge of the lid.

FIG. 6 is a cross sectional view taken along line 6—6 of FIG. 5.

FIG. 7 is a plan view similar to FIGS. 2 and 5 but illustrating another alternate embodiment of the invention with a contoured glow surface.

FIG. 8 is a cross sectional view taken along line 8—8 of FIG. 7.

FIG. 9 is a perspective illustration of an additional embodiment of the invention with plural ampules.

FIG. 10 is a cross sectional view taken along line 10—10 of FIG. 9.

FIG. 11 is a perspective illustration showing an enlarged glow surface.

FIG. 12 is a cross sectional view taken along line 12—12 of FIG. 11.

FIG. 13 is another alternate embodiment illustrating a removable name tag.

FIG. 14 is a cross sectional view taken along line 14—14 of FIG. 13.

FIG. 15 is another alternate embodiment of the invention illustrating the lid containing a glowable item of jewelry such as a necklace.

FIG. 16 is a cross sectional view taken along line 16—16 of FIG. 15.

FIG. 17 is a final alternate embodiment of the invention illustrating an electrical assembly for causing the illumination of the lid.

FIG. 18 is a cross sectional view taken along line 18—18 of FIG. 17.

The same reference numerals refer to the same parts throughout the various Figures.

DESCRIPTION OF THE PREFERRED EMBODIMENT

Figure 1:
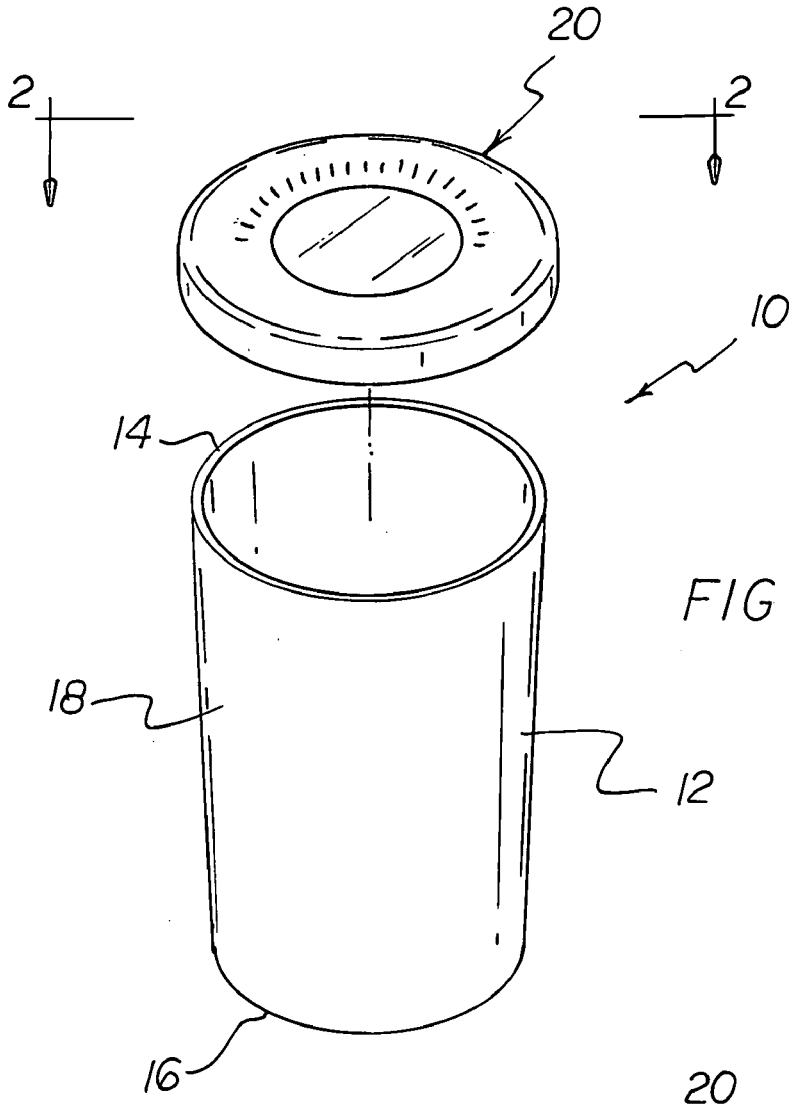
FIG. 1 is a perspective illustration of a cup lid system constructed in accordance with the principles of the present invention.
Figure 2:
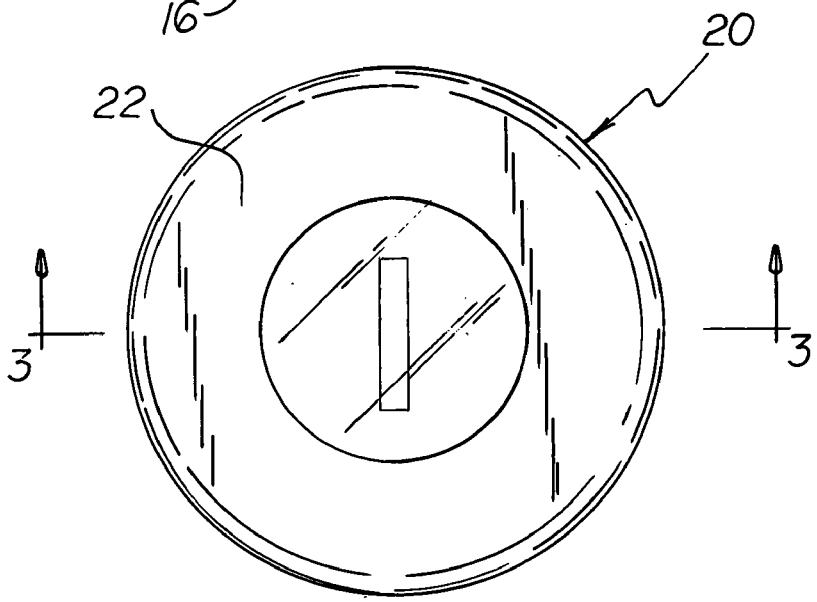
FIG. 2 is a plan view taken along line 2—2 of FIG. 1.

With reference now to the drawings, and in particular to FIG. 1 thereof, the preferred embodiment of the new and improved cup and lid system embodying the principles and concepts of the present invention and generally designated by the reference numeral 10 will be described.

The present invention, the cup and lid system 10 is comprised of a plurality of components. Such components in their broadest context include a lid, a first chemiluminescent liquid, an ampule and a second chemiluminescent liquid. Such components are individually configured and correlated with respect to each other so as to attain the desired objective.

First provided is a cup 12 of a generally cylindrical configuration with a first diameter and a first height. The cup is fabricated of a translucent material. The cup has a top lip 14 and a bottom 16 and a cylindrical side edge 18.

Next provided is a lid 20. The lid is of a generally cylindrical configuration of a second diameter and a second height. The second diameter is slightly larger than the first diameter. The second height is considerably less than the first height. The lid is fabricated of a translucent material. The lid has a circular top portion 22 and a cylindrical peripheral lower lip portion 24. The top portion has a hollow chamber 26. The hollow chamber has a rigid lower wall 28 and an upper wall 30 formed of a relatively flexible material. The rigid lower wall has a curved recess 32. The lid is adapted to be removably coupled to the top lip of the cup.

A first chemiluminescent liquid 34 is next provided. The first chemiluminescent liquid is located throughout the hollow chamber.

Next provided is a glass ampule 36. The glass ampule is located within the hollow chamber. The glass ampule is restrained from movement by the curved recess of the lower wall of the hollow chamber. The glass ampule is adapted to be broken by a user upon deformation of the flexible material.

Finally, a second chemiluminescent liquid 38 is provided. The second chemiluminescent liquid is located within the ampule. The second chemiluminescent liquid is adapted to intermix with the first liquid and fill the hollow chamber upon breaking of the ampule. When the first and second chemiluminescent liquids intermix, illumination is produced within the lid.

In an alternate embodiment of the invention, the hollow chamber 44 extends to the peripheral lower lip portion 42 which is also hollow. In this embodiment, the first chemiluminescent liquid and the second chemiluminescent liquid enter the lip portion and illuminate it. This embodiment is illustrated in FIGS. 5 and 6.

In another alternate embodiment of the invention, the upper wall 48 of the lid has a three dimensional novel shape with the outer edge 50 having a flexible interior extent adapted to break the ampule upon compression of the upper wall. The novel shape of the upper wall of the lid may be a sports ball. A football is illustrated in FIGS. 7 and 8.

Still another alternate embodiment of the invention is shown in FIGS. 9 and 10. In this embodiment, a plurality of ampules 58 are provided and a plurality of curved recesses 56 are provided in the hollow chamber. The recesses are adapted to hold the ampules. In this embodiment, the upper wall of the hollow chamber has a recess 60 to hold the ampules in the curved recesses.

Another alternate embodiment is shown in FIGS. 11 and 12. In this embodiment, the region of the lid receiving the chemiluminescent liquids is of an enlarged size encompassing essentially the entire upper surface of the lid 64. In such embodiment, the ampules are coupled together by a fabric strap 66. A felt layer 68 is provided on the upper extent of the region receiving the chemiluminescent liquids.

Another embodiment of the invention is shown in FIGS. 13 and 14. In this embodiment the lid is in the form of a generally cylindrical name tag 72. The upper surface 74 has indicia and the lower surface adapted to receive an adhesive for attaching to a wearer.

A further embodiment of the invention is shown in FIGS. 15 and 16. In this embodiment, the lid supports a generally torus-shaped piece of jewelry 80 such as a necklace or bracelet. A recess 82 in the lid removably receives the jewelry.

In a final embodiment, the lid supports an illuminatable bulb 86. A switch 88 is also provided. A power source 90 couples the bulb and switch whereby raising the switch will allow contact between electrical components for illumination purposes. The lid has a recess 92 for receiving the electrical components. Note FIGS. 17 and 18.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cup and lid system comprising:

a cup of a generally cylindrical configuration with a first diameter and a first height being fabricated of a translucent material having a circular top lip and a circular bottom and cylindrical side edge;

a lid of a generally cylindrical configuration of a diameter and a height and being fabricated of a translucent material having a top portion and a peripheral lower lip portion extending downwardly a first distance, the top portion having a hollow chamber with a rigid lower wall and an upper wall being formed of a relatively flexible material, the lower wall having a curved central recess extending downwardly a second distance less than the first distance, the lid supporting a generally torus-shaped piece of jewelry such as a necklace or bracelet and the lid has a recess for removably receiving the jewelry;

a first chemiluminescent liquid located in the hollow chamber;

an ampule located within the curved recess of the lower wall of the hollow chamber and adapted to be broken by a user upon compression of the flexible material; and a second chemiluminescent liquid located within the ampule and adapted to intermix with the first liquid and fill the hollow chamber, the recess being located within the space between the lower lip and extending toward the cup.

2. A cup and lid system comprising:

a cup of a generally cylindrical configuration with a first diameter and a first height being fabricated of a translucent material having a circular top lip and a circular bottom and cylindrical side edge;

a lid of a generally cylindrical configuration of a diameter and a height and being fabricated of a translucent material having a top portion and a peripheral lower lip portion extending downwardly a first distance, the top portion having a hollow chamber with a rigid lower wall and an upper wall being formed of a relatively flexible material, the lower wall having a curved central recess extending downwardly a second distance less than the first distance;

an illuminatable bulb within the lid and further including a switch and a power source coupling the bulb and switch whereby raising the switch will allow contact between electrical components for illumination purposes and wherein the lid has a recess for receiving the electrical components.

* * * * *